US005563201A

United States Patent [19]

Joanicot et al.

[11] Patent Number: 5,563,201

[45] Date of Patent: Oct. 8, 1996

[54] AQUEOUS PAPERCOATING COMPOSITIONS COMPRISING A SUBSTANTIALLY $H_2O$-INSOLUBLE, ALKALI-SOLUBLE LATEX

[75] Inventors: Mathieu Joanicot, La Haye En Rose; Jean-Pierre Lavallee, Saint Prix; Roland Reeb, Gressy, all of France

[73] Assignee: Rhone-Poulenc Chimie, Courbevoie Cedex, France

[21] Appl. No.: 292,313

[22] Filed: Aug. 18, 1994

Related U.S. Application Data

[63] Continuation of Ser. No. 868,238, Apr. 14, 1992, abandoned.

[30] Foreign Application Priority Data

Apr. 15, 1991 [FR] France ..... 91 04565

[51] Int. Cl.[6] ..... C08K 3/26

[52] U.S. Cl. ..... 524/425; 524/522; 525/329.7; 525/329.9; 525/330.3; 525/330.5; 525/374; 525/376; 525/577; 525/386

[58] Field of Search ..... 524/425, 522; 525/329.7, 329.9, 330.3, 330.5, 374, 376, 377, 386

[56] References Cited

U.S. PATENT DOCUMENTS 3,963,843 6/1976 Hitchmough et al. ..... 427/361
4,952,623 8/1990 Auchter et al. ..... 524/522
5,093,449 3/1992 Durney Cronin et al. ..... 524/522

FOREIGN PATENT DOCUMENTS 0244250 11/1987 European Pat. Off. .
2444114 7/1980 France .
1919379 10/1969 Germany .

OTHER PUBLICATIONS

World Patents Index, Week 7614, Derwent Publications Ltd., London, GB; AN–7624612X & DD–A–117 688 (Steffers) 20 Jan. 1976.

*Primary Examiner*—Peter D. Mulcahy
*Attorney, Agent, or Firm*—Burns, Doane, Swecker & Mathis, L.L.P.

[57] ABSTRACT

Rheologically/water retentivity improved aqueous papercoating compositions comprise immixture, in water, of (i) a water-insoluble, non-alkali-swellable latex A of a film-forming polymer having a mean particle size $\phi_A$ ranging from 60 to 300 nm, (ii) a water-insoluble, alkali-swellable latex B of a polymer having a mean particle size $\phi_B$ ranging from 20 to 150 nm measured at a pH of from 2 to 4 and swelling at least 1.5 times in diameter in an alkaline medium, and (iii) an inorganic pigment C which comprises at least 40% by weight of $CaCO_3$.

19 Claims, No Drawings

AQUEOUS PAPERCOATING COMPOSITIONS COMPRISING A SUBSTANTIALLY $H_2O$-INSOLUBLE, ALKALI-SOLUBLE LATEX

This application is a continuation of application Ser. No. 07/868,238, filed Apr. 14, 1992, now abandoned.

BACKGROUND OF THE INVENTION

1. Field of the Invention

The present invention relates to aqueous papercoating compositions comprising an alkali-swellable latex which is substantially insoluble in water.

2. Description of the Prior Art

The papercoating compositions generally known to this art are typically aqueous coating compositions containing a filler (pigment), a binder and, optionally, various adjuvants.

Such compositions are applied to paper for purposes of modifying the surface properties thereof, especially the brightness, the gloss, the printability, and the like.

The incorporation of a film-forming synthetic organic polymer latex as a binder material therefor, in the form of an aqueous emulsion, is a usual practice in the paper industry.

It is important, especially in order to control drying and to improve printability, that the water content of the coating composition and the water-soluble compounds contained in such water are not transferred rapidly from the coating composition into the paper substrate. To avoid these problems, a hydrocolloid or a natural thickening agent such as carboxymethyl cellulose or one of a synthetic variety, such as polyvinyl alcohol and alkali-soluble latices are typically included in the composition.

By the "water retention" of a papercoating composition is intended the ability of the composition to resist such water transfer.

This water retention must be high and well regulated because, otherwise, the centesimal composition of the coating composition varies very rapidly at the time of the coating, resulting in a complete modification of the rheological properties thereof, deteriorating its spreadability.

By "alkali-swellable latex" is intended a latex which is swollen by alkalis (in particular sodium hydroxide, potassium hydroxide, and aqueous ammonia) which are present in or added to the aqueous emulsion. These latices permit the formulation of coating compositions whose viscosities increase with a pH in the alkaline region.

The incorporation of alkali-swellable latices improves the water retention and the rheological properties of the coating composition.

Such insoluble alkali-swellable latices are described, for example, in FR-A-2,444,114 and comprise a styrene/butadiene/acrylic acid copolymer in which the viscosity of the coating bath is stabilized by addition of a polyalkylene glycol and in U.S. Pat. No. 3,793,244, where the acrylic acid is replaced with itaconic acid.

FR-A-2,006,324 describes an aqueous papercoating composition comprising a mixture of latices, including 80% to 99% by weight of an insoluble and non-alkali-swellable latex, and 1% to 20% by weight of an insoluble and alkali-swellable latex, rendered insoluble by means of 1,3-butadiene.

However, 1,3-butadiene is strongly hydrophobic, and this makes it necessary to employ large quantities of acidic monomers, which cause the polymer to go into solution; this results in a great increase in the viscosity of the bath and a deterioration in the binding capacity thereof.

Furthermore, this '324 patent is silent in respect of the latex particle size; likewise in respect of any requirement that the pigment must necessarily contain a minimum amount of $CaCO_3$.

SUMMARY OF THE INVENTION

Accordingly, a major object of the present invention is the provision of improved papercoating compositions exhibiting a better water retention and better coatability/runability.

Another object of the present invention is the provision of improved coating compositions exhibiting enhanced coatability, namely, having a high coating solids content in combination with a suitable viscosity, i.e., one which is low and which varies only slightly during the coating operation.

Yet another object of this invention is the provision of coating compositions of the above type which provide improved gloss, despite the incorporation of carbonate therein, both in respect of paper and printing ink.

Another object of this invention is the provision of coating compositions of the above type which exhibit an appreciable reduction in ink resistance and in mottling when wet.

Still another object of this invention is the provision of compositions of the above type in which the pigment comprises at least 40% of $CaCO_3$ and having acceptable gloss, while exhibiting a suitable water retention and a high solids content.

Another object of the invention is the provision of compositions of the above type which can be completely free from natural or synthetic thickeners.

Still another object of the invention is the provision of compositions of the above type in which the binder component comprises a mixture of two water-insoluble latices, one of which is alkali-swellable, such mixture being stable in storage at a neutral or slightly acidic pH.

Still another object of the present invention is the provision of compositions of the above type, exhibiting a high water retention without an accompanying increase in the viscosity of the aqueous phase due to a significant partial solubilization of the carboxylated alkali-swellable latex.

Briefly, the present invention features aqueous compositions for papercoating at an alkaline pH, comprising (i) a water-insoluble and non-alkali-swellable vinyl polymer latex A having a mean particle diameter $\phi_A$ ranging from 60 to 300 nm, (ii) an alkali-swellable polymer latex B having a mean particle diameter $\phi_B$ ranging from 20 to 150 nm, measured at a pH ranging from 2 to 4 and capable of swelling at least 1.5 times in diameter in an alkaline medium, and (iii) an inorganic pigment C comprising at least 40% by weight of $CaCO_3$.

DETAILED DESCRIPTION OF THE PREFERRED EMBODIMENTS OF THE INVENTION

More particularly according to the present invention, the ratio $\phi_A/\phi_B$, measured at a pH ranging from 2 to 4, preferably ranges from 1.4 to 6, more preferably from 1.8 to 3.0; even more preferably this ratio is close to 2.

The latex A is a substantially water-film-forming latex which is not alkali-swellable in alkaline solutions of pH higher than 8, preferably higher than 9 and lower than 13.

The latex A may be an organic polymer latex typically used for papercoating, insofar as it is a film-forming latex which is substantially insoluble and not alkali-swellable, in which the polymer particle diameter $\phi_A$ ranges from 60 to 300 nm.

The latex A is preferably a copolymer based on styrene/1,3-butadiene. Copolymers based on 25% to 60% by weight of butadiene, 40% to 75% by weight of styrene and 0% to 6% of ethylenically unsaturated monomers containing at least one carboxylic acid functional group and the monoesters thereof with a $C_1$–$C_8$ alkanol are particularly suited.

Exemplary such monomeric carboxylic acids include acrylic acid, methacrylic acid or dimer thereof, fumaric acid, erotonic acid, itaconic acid, maleic acid and the monoesters of the above acids with $C_1$–$C_8$ alkanols, such as methyl acrylate, ethyl acrylate, propyl acrylate, n-butyl acrylate, 2-ethylhexyl acrylate, methyl methacrylate, ethyl methacrylate and n-butylmethacrylate.

These latices and the preparation thereof are well known to this art and are widely described in the patent literature. Thus, these latices typically comprise from 0.1% to 2% by weight, relative to the total weight of the monomers, of a transfer agent (chain limiter) such as tert-dodecyl mercaptan or lauryl mercaptan, or halogenated compounds such as carbon tetrachloride.

The latex B is preferably a copolymer: monoester of a carboxylic acid containing ethylenic unsaturation/carboxylic acid containing ethylenic unsaturation/vinylaromatic and/or vinyl nitrile.

Exemplary such monoesters of ethylenically unsaturated carboxylic acids include the acrylates, methacrylates, fumarates and maleates of methyl, ethyl, isopropyl, propyl, isobutyl, n-butyl, tert-butyl and 2-ethylhexyl alcohols.

Exemplary ethylenically unsaturated carboxylic acids include an acid or a mixture of acids referred to above in respect of the latex A, namely, preferably acrylic acid, methacrylic acid, itaconic acid, fumaric acid and maleic acid.

The latex B additionally includes a third comonomer selected from a vinylaromatic monomer such as styrene and methylstyrene and/or a vinyl nitrile such as acrylonitrile or methacrylonitrile.

The latex B also includes a comonomer containing at least two sites of ethylenic unsaturation which functions as a crosslinking agent and which is incorporated in the polymer during the polymerization of the monomers. Such crosslinking agent is advantageously selected from among ethylene glycol di(meth)acrylate, tripolypropylene glycol diacrylate, trimethylolpropane tri(meth)acrylate, allyl (meth)acrylate, diallyl maleate, triallyl cyanurate, divinylbenzene and methylenebisacrylamide.

The crosslinking agents are preferably used in a proportion of 0.1% to 5%, preferably from 0.2% to 1%, by weight relative to the total weight of monomers, the preferred crosslinking agents being ethylene glycol dimethacrylate and divinylbenzene.

One skilled in this art can easily adapt the percentage of crosslinker as a function, more particularly, of the carboxylated monomer content and of the desired swelling of the latex B.

A latex B which is more particularly suitable comprises a copolymer of 55% to 65% by weight of an ester of an unsaturated carboxylic acid, preferably ethyl acrylate, 10% to 20% by weight of an unsaturated carboxylic acid, preferably methacrylic acid, 20% to 32% by weight of styrene and 0.1% to 5% by weight of a crosslinking agent.

A monomer mixture which is particularly suited contains 58% to 60% by weight of ethyl acrylate, 14% to 16% by weight of methacrylic acid, 25% to 27% by weight of styrene and 0.2% to 1% by weight of a crosslinking agent.

The polymerization of the latex B is carried out in one or more stages, in a manner per se known to this art.

Any of the conventional dispersion polymerization techniques can be employed.

Thus, the monomers may be preemulsified with water in the presence of an anionic or nonionic emulsifying agent, approximately from 0.01% to 10% thereof, calculated on the basis of the weight of the total monomers, being usually employed. A polymerization initiator of the free radical generator type, such as ammonium or potassium persulfate, may be employed, either alone or in combination with an accelerator such as sodium metabisulfite or sodium thiosulfate, sodium formaldehyde sulfoxylate and metal ions (iron, cobalt, copper, etc.). It is also possible to include free radical generators such as azo compounds (2,2'-azobisisobutyronitrile, 4,4'-azobis(4-cyanopentanoic acid), etc.) or peroxides such as aqueous hydrogen peroxide or tert-butyl hydroperoxide or cumene hydroperoxide in combination with a reducing agent.

The initiator and the accelerator, together constituting what is typically referred to as a catalyst, can be employed in a proportion of 0.1% to 2% of each on the basis of the weight of the monomers to be copolymerized. The polymerization temperature may range from 30° C. to 100° C., more preferably from 50° C. to 90° C.

Exemplary such emulsifying agents notably include alkali metal and ammonium salts of alkyl, aryl, alkylaryl and arylalkyl sulfonates and sulfates or polyether sulfate, the corresponding phosphates and phosphonates, and ethoxylated fatty acids, esters, alcohols, amines, amides and alkylphenols.

The polymer must also be crosslinked during polymerization. For this purpose, crosslinking agents are incorporated during polymerization, these being monomers containing several, namely, at least 2, sites of ethylenic unsaturation, in an amount ranging from 0.1% to 5%. Exemplary such monomers include ethylene glycol di(meth)acrylate, tripropylene glycol diacrylate, trimethylolpropane tri(meth)acrylate, allyl(meth)acrylate, diallyl maleate, triallyl cyanurate, divinylbenzene and methylenebisacrylamide.

It is possible to polymerize a monomer or a portion of the monomers in a first stage and then to subsequently add the other monomers such as to form heterogenous particles. A portion or all of the carboxylic acid-based monomers may thus be added continuously or in portions after the beginning of the polymerization, in order to ensure that a sufficient quantity of acidic functional groups is situated at the surface of the polymer particles formed during the polymerization.

After polymerization the latex B may be adjusted to a neutral or slightly acidic pH ranging from 4 to 7 using one or more bases such as alkali metal hydroxides, aqueous ammonia or water-soluble organic amines such as 2-amino-2-methylpropanol, diethylaminoethanol or quaternary ammonium salts such as tetrabutylammonium hydroxide.

From 5% to 25%, preferably 10% to 15% by weight of latex B is preferably employed in relation to the total amount of the solids contents of the latices A and B. If the latex B content is lower than 5%, the water retention would be insufficient and if it is higher than 25%, the viscosity of the coating composition would be too high. Furthermore, the aqueous coating composition has a solids content, namely, the content in solid matter, concentration (pigment plus latex A and B particles) which preferably ranges from 60% to 80% by weight, more preferably from 65% to 75%.

The latex A may have a solids content ranging from 40% to 60% by weight, preferably from 50% to 55%. The latex B advantageously has a solids content ranging from 30% to 50% and preferably from 40% to 45% by weight.

Furthermore, there are from 5 to 20 parts of solids contents of latices A and B, preferably from 7 to 15 parts, per 100 parts by weight of pigment.

At least 40% by weight of the pigment is $CaCO_3$, the remainder being selected from among inorganic pigments usually employed in papercoating, such as natural or calcined clay, kaolin, barium sulfate, titanium dioxide, talc, alumina hydrate, bentonite and calcium sulfoaluminate (satin white). All of the pigment preferably is ground and/or precipitated $CaCO_3$ optionally treated with a fatty acid ester such as calcium stearate.

In a preferred embodiment of the present invention, particular in the event of a precoating operation, at least 50% by weight of the pigment has a particle size of less than 2 μm, preferably less than 1 μm, the remainder having a particle size ranging from 2 to 10 μm, The pigments of fine particle size are advantageously precipitated $CaCO_3$, kaolin, calcined clay or alumina hydrate; the pigments of coarser particle size are generally $CaCO_3$ and baryta (ground natural barium sulfate).

The coating compositions according to the present invention have an apparent viscosity ranging from 50 to 1,000 mPa.s at 25° C. before the addition of alkali (preferably $NH_4OH$ or NaOH such as to provide a pH ranging from 8 to 13, preferably from 9 to 10).

After the addition of alkali, these same compositions have an apparent viscosity which generally ranges from 4,000 to 25,000 mPa.s at 25° C., preferably from 5,000 to 10,000 mPa.s (Brookfield 10 rev/min).

It is also possible, while retaining at least 40% of pigment as $CaCO_2$, to replace all or a part of the inorganic pigment with plastic polymeric pigments having a particle size ranging from 0.05 to 1 μm, as described in FR-A-2,009,372 and U.S. Pat. No. 4,069,188.

To prepare the binder, the latex A emulsion and the latex B emulsion are prepared with the latex B emulsion advantageously being introduced into the latex A emulsion while homogenizing the mixture, the pH of latex A having previously been adjusted to a value ranging from 4 to 7, preferably from 5.5 to 6.5.

The mixture of the latices A and B, which are preferably prepared as above, is stable in storage at a pH which preferably ranges from 5 to 7 for at least several months. According to the invention, by "stable in storage" is intended that no appreciable change is observed in viscosity, in the particle size of emulsions and in the pH of the mixture. The $CaCO_3$-based pigment dispersion described above is incorporated into this latex mixture simply by mixing and without any special precautions. The pH is adjusted to a value ranging from 8 to 13 and preferably from 9 to 10 and the coating composition is ready for use.

The coating compositions according to the invention can be employed as such without the addition of conventional natural binders such as casein, starch, carboxymethyl cellulose or of synthetic thickeners such as polyvinyl alcohol and alkali-soluble latices as described, for example, in U.S. Pat. No. 4,397,984; they are more particularly useful for the production of coated papers and are especially useful for offset rotary and offset printing and in lithography.

The compositions according to the invention can be employed in a proportion of 5 to 30 g, preferably 10 to 20 g of composition per $m^2$ (1 face surface) of paper.

A single or multiple coats may be applied and it is also possible to employ a precoated paper.

In order to further illustrate the present invention and the advantages thereof, the following specific examples are given, it being understood that same are intended only as illustrative and in nowise limitative.

Unless otherwise indicated, in said examples to follow, as well as in the above description, the viscosities are Brookfield viscosities measured at 23° C. Also unless otherwise indicated, all parts and percentages are given by weight.

EXAMPLE 1

Synthesis of latex B:

The latex B was prepared in a stainless steel reactor fitted with a jacket and an impeller stirrer. The following ingredients were charged into the cold reactor:

Water : 164 parts by weight,

Alkylbenzene sulfonate: 0.5 parts by weight.

This emulsifier solution was heated to 82° C. and the following materials were then introduced in succession:

Ammonium persulfate: 0.2 parts by weight,

Water: 1 part by weight, followed, at a constant flow rate over a period of 4 hours, 30 min, by a monomer mixture of:

Ethyl acrylate: 59 parts by weight,

Styrene: 24.5 parts by weight,

Methacrylic acid: 16 parts by weight,

Ethylene glycol dimethacrylate: 0.5 parts by weight.

After the monomer mixture had been introduced for 15 minutes, an aqueous solution of the following mixture was also added over a period of 4 hours, 45 min:

Water: 4 parts by weight, Ammonium alkylaryl ether sulfate containing 25 molecules of ethylene oxide: 1 part by weight, Ammonium persulfate: 0.2 parts by weight.

The temperature of the reaction mixture was maintained constant at 82° C. throughout duration of the polymerization.

Two hours after the end of the introduction of the solution containing the catalyst and the emulsifier, this latex was cooled to room temperature.

Characteristics of the latex B:

SC=40.2% (solids content) Brookfield viscosity (50 rev/min): 400 mPa.s pH=2.3 Particle size=60 nm (Transmission electron microscopy).

EXAMPLE 2

Characterization of the Swelling of the Latex B as a Function of pH:

The latex B produced in Example 1 was neutralized with dilute aqueous ammonia (2%).

The change in the particle size thereof was measured as a function of pH by quazielastic light scattering with the aid of a Coulter Nano-Sizer®.

In order to maintain the pH of the latex constant, it was diluted in buffer solutions having a pH identical with that of the latex. The buffer solutions were prepared according to the *Handbook of Chemistry and Physics,* Section D.

The results obtained are reported in Table 1 below:

TABLE 1

| pH | PARTICLE SIZE (nm) |
|---|---|
| 2.3 | 68 |
| 4 | 69 |
| 5.6 | 77 |
| 6.4 | 82 |
| 7.2 | 93 |
| 8.2 | 112 |
| 8.5 | 132 |
| 9.2 | 170 |
| 10 | 175 |

EXAMPLES 3 AND 5 AND COMPARATIVE EXAMPLES 4 AND 6

The following ingredients were used as starting materials for preparing a coating composition:

(a) Latex A:

The starting material was a latex A which had the following composition:

Styrene: 59.5% by weight, 1,3-Butadiene: 37.0% by weight,

Acrylic acid: 3.5% by weight,

In addition, the polymer contained 1% by weight of tert-dodecyl mercaptan, relative to the total weight of the above 3 monomers.

Mean particle size: 130 nm pH: 5.5

Viscosity (50 rev/min): 300 mPa.s.

This latex A was substantially insoluble and nonswelling in an aqueous dispersion (slurry) of ammonium hydroxide at pH 9.

(b) Calcium carbonate:

Two different calcium carbonates $C_1$ and $C_2$ were employed in an aqueous slip containing 70% by weight of carbonate.

$C_1$ has 90% of particles which had a particle size of less than 2 μm and 60% of particles which had a particle size of less than 1 μm.

$C_2$ had 95% of particles which had a particle size of less than 2 μm and 78% of particles which had a particle size of less than 1 μm.

(c) Carboxymethyl cellulose:

CMC is employed in Comparative Examples 4 and 6 instead of the latex B.

(d) Dispex N40®:

This was the sodium salt of a polyacrylate of low molecular weight.

The following ingredients, in which the parts by weight were calculated on a dry basis, were mixed to produce the coating composition of Example 3.

$C_1$: 100 parts, $D_1$: 0.30 parts,

Latex A: 8.50 parts,

Latex B: 1.50 parts,

Solids content: 73.50 (%), pH: 95,

Viscosity (10 rev/min): 4400 mPa.s.,

Viscosity (100 rev/min): 1050 mPa.s.,

Water retention: 40 s,

Blade pressure: 4 (relative unit).

$C_1$ was dispersed in water in a high speed mixer in the presence of $D_1$, which was used as a dispersing agent for $C_1$, and the mixture of latex A and latex B was added, the pH of the latex A having first been adjusted to a value ranging from 6 to 6.5.

The solids content was adjusted to 73.50% by weight and the pH of the mixture was then increased to 9–10 by adding an aqueous ammonia solution and the viscosity and the water retention of the mixture were measured.

The water retention was evaluated by conductimetric measurement of the rate of penetration of a blotting paper by the water released by the coating bath. This test, known as a Warren test, is described in the publication *TAPPI,* Volume 41, No. 2, page 77 (Feb. 1958).

Paper was coated on a Bachofen® pilot machine, which is a high speed doctor blade coating machine; the blade angle was 45° C. The coating speed was 300 m/min, the speed of the inking roller was 70 m/min and the drying with dry air was carried out at 185° C.; 11 g/m$^2$ of dry solids were deposited. The moisture content in relation to the coated paper was 4.5%.

The paper gloss (75° C.) and the ink gloss (75° C.) were measured on the coated and printed paper after drying for 24 hours, with the aid of an Erichsen® glossmeter and a Prufbau® press, the printing force of which was set at 800N.

The dry pick strength was also assessed on the coated paper according to the standard TAPPI Standard T-499. A Lorilleux® 3805 or 3808 ink was employed for this purpose, an electrical IGT press being employed, the final speed of which was adjusted to 2 m/s.

The wet pick strength was conducted with a Lorilleux® 3801 ink on a Prufbau® press under a printing force of 800N at a speed of 0.5 m/s.

The optical density (OD) of the wet black inked area and the optical density (OD) of the picked wet area were measured. The wet pick score is provided by the ratio of the OD of the wet portion to the OD of the dry portion.

The ink resistance made it possible to assess the repulsion of the ink by the water during the offset printing of a wet coated paper. A Prufbau® press was employed for this purpose, fitted with a dampening device and with Huber® No. 1 ink at a printing force of 800N.

The OD of the unmoist inked area and the OD of the moist area were measured.

The ink resistance was then the ratio of the average of the optical density of the dry portion to the average of the optical density of the moist portion.

The results obtained are reported in Table 2 below.

To produce the coating compositions of the comparative Examples 4 and 6 and of Example 5, the procedure was exactly as in Example 3, except that the coating composition was modified as shown in Table 2. The results obtained are also reported in Table 2 below.

From Table 2 it will be seen that the replacement of CMC with the latex B permitted a slight gain in solids content and, notably, made it possible to attain a water retention which was 2 times higher.

A gain in the paper and ink gloss was also obtained, particularly in the case of $C_1$. Furthermore, the binding power of the coating composition was, in the case of Examples 3 and 5, at least equivalent if not higher (dry pick) than that of the compositions of comparative Examples 4 and 6 containing CMC instead of the latex B.

TABLE 2

| EXAMPLE | 3 | 4 | 5 | 6 |
|---|---|---|---|---|
| $C_1$ (part) | 100 | 100 | 0 | 0 |
| $C_2$ (part) | 0 | 0 | 100 | 100 |
| Dispex N40 ® (part) | 0.30 | 0.30 | 0.30 | 0.30 |
| Latex A (part) | 8.50 | 9.50 | 8.50 | 9.50 |
| Latex B (part) | 1.50 | 0 | 1.50 | 0 |
| CMC (part) | 0 | 0.50 | 0 | 0.50 |
| Solids content % | 73.5 | 71.2 | 66 | 66 |
| pH | 9.5 | 8.5 | 9.5 | 8.5 |
| Viscosity (10 rev/min) | 4,400 | 5,200 | 7,300 | 10,500 |
| Viscosity (100 rev/min) | 1,050 | 1,000 | 1,400 | 1,600 |
| Water retention (s) | 40 | 20 | 25 | 12 |
| Blade pressure (relative unit) | 4.0 | 4.0 | 2.0 | 3.0 |
| Paper gloss at 75° in % | 60 | 58 | 66 | 63 |
| Ink gloss at 75° in % | 74 | 69 | 60 | 60 |
| Dry pick (cm/s) | | | | |
| 3805 ink | 70 | 50 | — | — |
| 3808 ink | — | — | 130 | 130 |
| Wet pick | | | | |
| 3801 ink | 9.5 | 9.5 | 8.5 | 8.5 |
| Ink resistance | 1.3 | 1.0 | 5 | 4 |

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. An aqueous composition adapted for papercoating applications, comprising an immixture, in water, of (i) a water-insoluble, non-alkali-swellable latex A of a film-forming polymer having a mean particle size of $\phi_A$ ranging from 60 to 300 nm, (ii) a water-insoluble, alkali-swellable latex B of a polymer having a mean particle size $\phi_B$ ranging from 20 to 150 nm measured at a pH of from 2 to 4 and swelling at least 1.5 times in diameter in an alkaline medium, and (iii) an inorganic pigment C which comprises at least 40% by weight of $CaCO_3$, wherein said alkali-swellable latex B is crosslinked during polymerization with ethylene glycol di(meth)acrylate, tripropylene glycol diacrylate, trimethyllolpropane tri(meth)acrylate, allyl(meth)acrylate, diallyl maleate, triallyl cyanurate, divinylbenzene or methylenebisacrylamide, or mixtures thereof.

2. The composition as defined by claim 1, wherein the ratio $\phi_A/\phi_B$, measured at a pH of from 2 to 5, ranges from 1.8 to 3.0.

3. The composition as defined by claim 2, said ratio $\phi_A/\phi_B$ being about 2.

4. The composition as defined by claim 1, said latex A comprising a styrene 1,3-butadiene film-forming copolymer.

5. The composition as defined by claim 4, said latex A comprising a copolymer of 25% to 60% by weight of 1,3-butadiene, 40% to 75% by weight of styrene and 0% to 6% by weight of at least one ethylenically unsaturated monomer which comprises at least one carboxylic acid functional group and monoester thereof with a $C_1$–$C_8$ alkanol.

6. The composition as defined by claim 5, said latex A comprising a copolymer containing up to 6% by weight of acrylic acid, methacrylic acid or dimer thereof, itaconic acid, fumaric acid or maleic acid.

7. The composition as defined by claim 1, said latex B comprising a copolymer of monoester of a carboxylic acid containing ethylenic unsaturation/carboxylic acid containing ethylenic unsaturation/vinylaromatic compound and/or vinyl nitrile/monomer containing at least two sites of ethylenic unsaturation.

8. The composition as defined by claim 1, said latex B comprising a copolymer of 55% to 65% by weight of a monoester of an ethylenically unsaturated carboxylic acid, 10% to 20% by weight of an ethylenically unsaturated carboxylic acid, 20% to 32% by weight of styrene and 0.1% to 5% by weight of said ethylene glycol di(meth)acrylate, tripropylene glycol diacrylate, trimethyllolpropane tri(meth)acrylate, allyl(meth)acrylate, diallyl maleate, triallyl cyanurate, divinylbenzene or methylenebisacrylamide, or mixtures thereof.

9. The composition as defined by claim 8, said latex B comprising a copolymer of 58% to 60% by weight of ethyl acrylate, 14% to 16% by weight of methacrylic acid, 25% to 27% by weight of styrene and 0.2% to 1% by weight of said ethylene glycol dimethacrylate or divinylbenzene.

10. The composition as defined by claim 1, comprising from 5% to 25% by weight of said latex B, based on the total solids content weight of the latices A and B.

11. The composition as defined by claim 10, comprising from 10% to 15% by weight of said latex B.

12. The composition as defined by claim 1, having a solids content ranging from 60% to 80% by weight.

13. The composition as defined by claim 12, having a solids content ranging from 65% to 75% by weight.

14. The composition as defined by claim 1, comprising a solids content of from 5 to 20 parts by weight of said latices A and B per 100 parts by weight of said pigment C.

15. The composition as defined by claim 1, at least 50% by weight of said pigment C having a particle size of less than 2 μm and the remainder thereof having a particle size ranging from 2 to 10 μm.

16. The composition as defined by claim 15, at least 50% by weight of said pigment C having a particle size of less than 1 μm.

17. The composition as defined by claim 1, having a pH ranging from 8 to 13 and an apparent viscosity ranging from 4,000 to 25,000 mPa.s at 25° C.

18. The composition as defined by claim 17, having an apparent viscosity ranging from 5,000 to 10,000 mPa.s at 25° C.

19. The composition as defined by claim 1, having a pH ranging from 5 to 7.

* * * * *